US006045928A

United States Patent [19]

Tsantrizos et al.

[11] Patent Number: 6,045,928

[45] Date of Patent: Apr. 4, 2000

[54] THERMAL BARRIER COATING SYSTEM HAVING A TOP COAT WITH A GRADED INTERFACE

[75] Inventors: Peter G. Tsantrizos, Montreal; George E. Kim, Isles des Soeurs; Alexander P. Cavasin, Vercheres; Serge Grenier, Montreal, all of Canada

[73] Assignee: Pyrogenesis Inc., Montreal, Canada

[21] Appl. No.: 09/237,243

[22] Filed: Jan. 26, 1999

[30] Foreign Application Priority Data

Feb. 9, 1998 [CA] Canada ..... 2229124

[51] Int. Cl.[7] ..... B32B 5/14; B32B 15/04; B32B 18/00; C23C 4/10

[52] U.S. Cl. ..... 428/623; 428/332; 428/680; 428/610; 428/699; 428/701; 428/432; 428/472; 428/633; 427/576; 416/241 B

[58] Field of Search ..... 427/533, 535, 427/569, 576, 248.1, 567; 416/241 B; 428/629, 623, 630, 650, 655, 678, 680, 666, 667, 702, 633, 472, 472.1, 201, 432, 610, 613, 332, 699, 701

[56] References Cited

U.S. PATENT DOCUMENTS

| | | | |
|---|---|---|---|
| 4,248,940 | 2/1981 | Goward et al. | 428/633 |
| 4,676,994 | 6/1987 | Demaray | 428/42 |
| 5,080,977 | 1/1992 | Zaplatynsky | 428/432 |
| 5,281,487 | 1/1994 | Rumaner et al. | 428/552 |
| 5,305,726 | 4/1994 | Scharman et al. | 123/668 |
| 5,320,909 | 6/1994 | Scharman et al. | 428/472 |
| 5,362,523 | 11/1994 | Gorynin et al. | 427/446 |
| 5,384,200 | 1/1995 | Giles et al. | 428/552 |
| 5,562,998 | 10/1996 | Strangman | 428/612 |
| 5,650,235 | 7/1997 | McMordie et al. | 428/610 |
| 5,652,044 | 7/1997 | Rickerby | 428/216 |
| 5,667,663 | 9/1997 | Rickerby et al. | 205/170 |
| 5,780,171 | 7/1998 | Nissley et al. | 428/629 |
| 5,792,521 | 8/1998 | Wortman | 427/567 |
| 5,846,605 | 12/1998 | Rickerby et al. | 427/255 |

*Primary Examiner*—Deborah Jones
*Assistant Examiner*—Michael LaVilla
*Attorney, Agent, or Firm*—George J. Primak

[57] ABSTRACT

The invention provides an improved thermal barrier coating system for a hot section component. The thermal barrier coating has a metallic bond coat and a ceramic top coat made of two constituents. The top coat is formed so that there is provided a graded interface between the monolithic layers of the two top coat constituents. This allows an increase in overall thickness of the thermal barrier coating which provides a higher thermal insulation for the component being protected.

7 Claims, 1 Drawing Sheet

THERMAL BARRIER COATING SYSTEM HAVING A TOP COAT WITH A GRADED INTERFACE

BACKGROUND OF THE INVENTION

1. Field of the Invention

This invention relates to an improved system of a thermal barrier coating (TBC) having a metallic bond coat and a thick dual-constituent top coat. In particular according to the present invention the two constituents of the top coat are separated by a graded interface which leads to an increase in the thickness of the top coat and improved quality of the overall TBC system.

2. Description of the Prior Art

It is accepted practice in the gas turbine engine industry to apply a TBC (typically an MCrAlY metallic bond coat layer followed by a ceramic partially-stabilized zirconia top coat layer) onto hot section components, to prolong their lives. Examples of components currently coated with TBC include combustor liners, transition ducts and first stage blades and vanes. U.S. Pat. No. 5,384,200 issued Jan. 24, 1995 discloses an example of such TBC where both the metallic and the ceramic layers of the TBC may be deposited by atmospheric plasma spray.

Applicant's own Canadian Patent Application No. 2,211,961 filed Jul. 29, 1997, discloses the possibility of using vacuum plasma spray (VPS) in the formation of the TBC on a structural superalloy layer of a combustion system component, and also the possibility of having a dual-constituent top coat in such TBC.

Moreover, it is also known to produce a coating with a continuous compositional gradient by co-depositing at least two powders onto a substrate by feeding them at separately controllable variable feed rates into a plasma torch. This is disclosed, for example, in U.S. Pat. No. 5,362,523 of Nov. 8, 1994. However, such graded coatings are not used as part of a TBC having a metallic bond coat and a ceramic top coat that are normally used to protect gas turbine engine components.

Current TBC systems widely used to protect gas turbine engine components include a VPS applied MCrAlY bond coat (typically~75–125 $\mu$m thick) followed by an atmospheric plasma sprayed (APS) yttria partially-stabilized zirconia top coat (typically~125–375 $\mu$m thick). This provides a temperature drop across the TBC of approximately 100 to 150° C. In addition to the TBC, components in the hot section normally require some cooling to further mitigate overheating. Much of the improvements to the turbine performance efficiency is directly related to the ability of increasing the allowable combustor and turbine entry temperature (TET).

OBJECTS AND SUMMARY OF THE INVENTION

It is an object of the present invention to provide improved performance and life of hot section components such as those of gas turbine engines, through the application of an advanced thermal barrier coating which provides a greater temperature drop.

Another object is to achieve the above mentioned improvement in a simple and efficient manner by including a graded interface within the TBC top coat, thereby increasing its thickness.

Other objects and advantages of the invention will become apparent from the following description thereof.

In essence, the novel thermal barrier coating system for a hot section component comprises:

(a) an MCrAlY bond coat applied to the component; and (b) a dual-constituent ceramic top coat having a graded interface between the two constituents, which allows an increase in thickness of the top coat, thereby providing for a greater temperature drop across the thermal barrier coating system.

As is already known from the prior art, in the metallic MCrAlY bond coat M is selected from Ni, Co, Fe or a combination thereof. According to the present invention the preferred composition thereof is CoNiCrAlY. The structural component is normally made of a superalloy, such as Ni—Cr alloy. And the ceramic top coat is preferably made of yttria-stabilized zirconia and calcia-silica ($Ca_2SiO_4$). The zirconia ($ZrO_2$) is usually stabilized with about 8% of yttria ($Y_2O_3$) as is known in the art. According to the present invention there is first provided a monolithic yttria-stabilized zirconia layer which is adjacent to the bond coat, followed by a graded interface of zirconia and calcia-silica with greatest amount of zirconia near the monolithic zirconia layer, said graded interface being followed by a monolithic calcia-silica layer which represents the outer surface of the TBC.

In conventional TBC systems, the most commonly employed top coat is $ZrO_2$ because it has a very low thermal conductivity; however, it cannot be deposited to thicknesses in excess of about 250 $\mu$m since it will then have a tendency to spall. In the corresponding Canadian Patent Application No. 2,211,961, applicants have disclosed the possibility of using admixtures of $ZrO_2$ and $Ca_2SiO_4$ to allow thicker coat deposits while obviating the problem of spalling. According to the present invention it has been found that especially important improvements are obtained for increasing both the turbine engine performance efficiency and the life of its hot section components when the dual-constituent ceramic top coat has a monolithic constituent at each end, with a graded interface therebetween. Thus, one constituent, such a $ZrO_2$, which bonds very well to the bond coat, is provided as a monolithic layer adjacent to the bond coat, whereas the other constituent, such as $Ca_2SiO_4$, is provided as a monolithic layer at the other end where it forms a uniform and smooth outer surface. Between these two monolithic layers, there is provided a graded interface of an admixture of the two constituents with the greatest proportion of $ZrO_2$ being closest to the $ZrO_2$ layer and the greatest proportion of the $Ca_2SiO_4$ being closest to the $Ca_2SiO_4$ outer layer. In this manner one can readily achieve a ceramic top coat having a thickness of at least 500 $\mu$m and usually over 1 mm with increased temperature drop across the TBC.

In order to achieve a particularly smooth outer surface, it is preferable to form at least the ceramic top coat of the TBC by vacuum plasma spray (VPS) which allows use of very fine particles. Most preferably, both the metallic bond coat and the ceramic top coat are deposited by VPS. Normally, the bond coat is deposited with a dense microstructure, while the top coat is produced with a controlled porosity to maximize its thermal barrier properties.

BRIEF DESCRIPTION OF THE DRAWINGS

The invention will now be described with reference to the appended drawings in which.

DETAILED DESCRIPTION OF THE INVENTION

Figure 1:
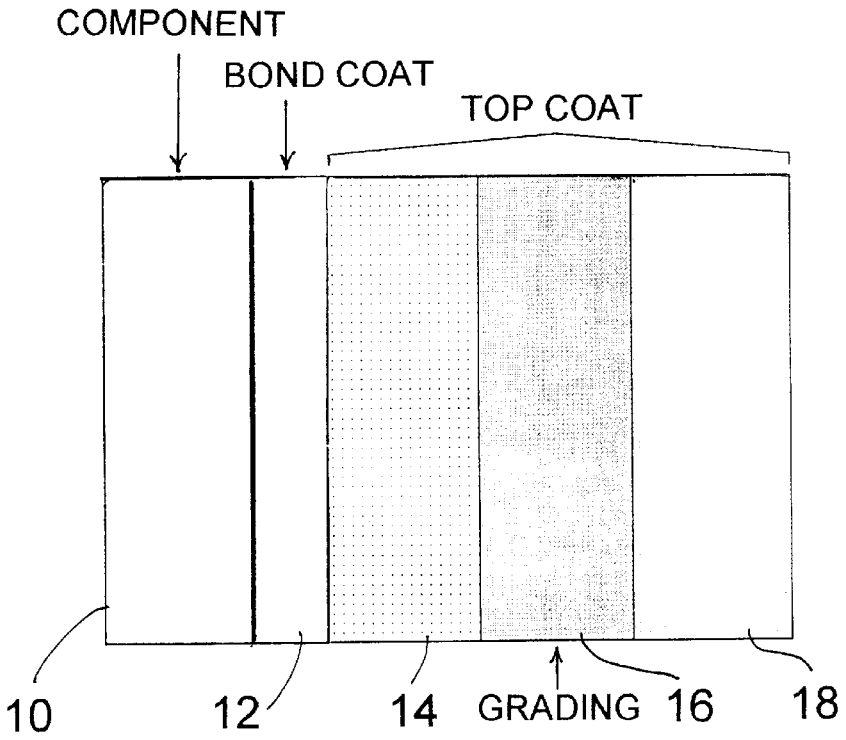
FIG. 1 is a schematic illustration of the various layers of the thermal barrier coating in accordance with the present invention deposited onto a component.

In the figures, where the same parts are designated by the same numerals, FIG. 1 provides an illustration of the various layers of the TBC of the present invention deposited on a superalloy component 10 which may consist, for example, of a Ni—Cr alloy.

The TBC comprises a metallic bond coat 12, made of MCrAlY and of a ceramic top coat consisting of two constituents 14 and 18 and a graded interface 16. Constituent 14 may, for example, be a layer of $ZrO_2$ partially stabilized with 8% $Y_2O_3$ and constituent 18 may be a layer of $Ca_2SiO_4$. The graded interface 16 consists of an admixture of the two constituents so graded as to have the highest amount of $ZrO_2$ near the $ZrO_2$ layer 14 and the highest amount of $Ca_2SiO_4$ near the $Ca_2SiO_4$ layer 18.

Figure 2:
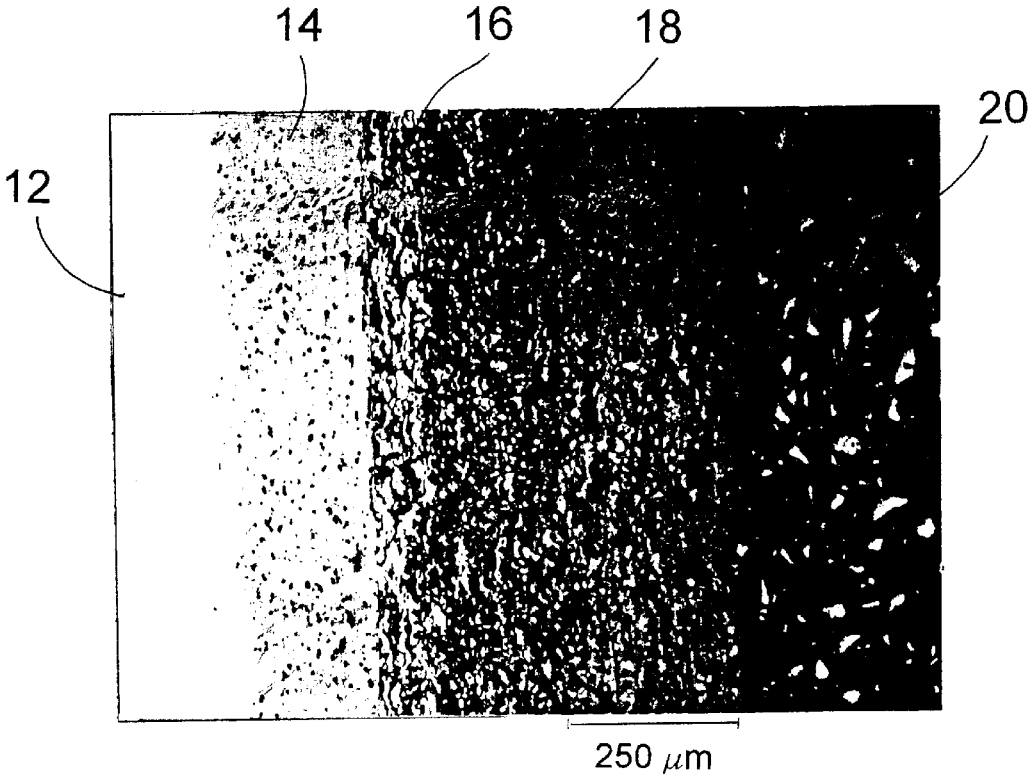
FIG. 2 is micrograph of the actual thermal barrier coating of the present invention mounted on an epoxy mounting.

In FIG. 2 a micrograph of an actual TBC in accordance with the present invention is shown. For purposes of photography, the TBC was mounted on an epoxy mounting 20. The metallic bond coat 12 shown in this micrograph consists of CoNiCrAlY and is followed by the ceramic top coat comprising a monolithic layer 14 of $ZrO_2$—8% $Y_2O_3$ followed by the grading 16 and a monolithic layer 18 of $Ca_2SiO_4$ which is approximately 250 $\mu$m in thickness. The scale bar at the bottom of the photograph shows the dimensional scale of the micrograph shown in FIG. 2. In this micrograph, the graded interface provides a significant increase in overall thickness as well as an excellent overall adhesion within the TBC. This provides a thermal insulation which is superior to the current TBC systems and which significantly reduces heat transfer and enhances resistance to thermal shock.

EXAMPLE

The following example illustrates a preferred method of fabrication of a thermal barrier coating in accordance with the present invention.

The base or substrate surface was grit blasted and ultrasound cleaned prior to its introduction into the VPS chamber. Upon closing the chamber door, the system was pumped down to $6\times10^{-3}$ mbar.

The following procedures were then carried out:

increase chamber pressure to 20–30 mbar with argon gas;

sputter clean substrate using reversed transferred arc;

preheat substrate with transferred arc to 700–800° C. surface temperature;

sputter clean substrate, again, using reversed transferred arc;

increase chamber pressure to 70 mbar, by introducing argon gas;

spray 4 passes of CoNiCrAlY (80–100 $\mu$m) [bond coat layer];

increase chamber pressure to 120–180 mbar, by introducing argon gas;

spray 10 passes of zirconia (200–250 $\mu$m) [first top coat constituent layer];

spray 3 passes of an admixture of zirconia (90 wt %) and calcia-silica (10 wt %);

spray 2 passes of an admixture of zirconia (80 wt %) and calcia-silica (20 wt %);

spray 1 pass of an admixture of zirconia (70 wt %) and calcia-silica (30%);

spray 1 pass of an admixture of zirconia (60 wt %) and calcia-silica (40 wt %);

spray 15 passes of calcia-silica (100 wt %) (500 $\mu$m).

It should be noted that the numbers of passes and the wt % of the respective ceramics (zirconia or calcia-silica) may be varied to obtain different thicknesses and gradings. The above data provide just one example of what can be deposited.

The graded layers of zirconia and calcia-silica allow for good adhesion between the two materials. Also, having the monolithic zirconia layer between the bond coat (CoNiCrAlY) and calcia-silica mitigates any reactivity between the two materials.

The novel TBC system can be applied to hot-section components such as combustor liners, transition ducts, first stage vanes and blades, etc. The improved thermal barrier characteristics allow for higher gas turbine engine efficiencies as well as for improved life of the components.

We claim:

1. A thermal barrier coating system for a hot section component, which comprises:

(a) an MCrAlY bond coat applied to the component;

(b) a dual-constituent ceramic top coat comprising:

(i) a monolithic zirconia layer adjacent to the bond coat as one constituent of the top coat;

(ii) a monolithic layer consisting essentially of calcia-silica as the other constituent of the top coat representing the outer surface of the thermal barrier coating system; and (iii) there being provided a graded interface between the monolithic zirconia layer and the monolithic calcia-silica layer, so as to achieve good adhesion between these two constituents of the top coat;

the monolithic zirconia layer, positioned between the bond coat and the monolithic calcia-silica layer, preventing reactivity between the calcia-silica layer and the bond coat while allowing an increase in thickness of said top coat thereby providing for a greater temperature drop across the thermal barrier coating system.

2. A thermal barrier coating system according to claim 1, wherein the MCrAlY bond coat is a CoNiCrAlY bond coat which is applied to a component made of Ni—Cr alloy.

3. A thermal barrier coating system according to claim 1, wherein the zirconia layer is a monolithic yttria-stabilized zirconia layer and the graded interface is a graded interface of zirconia and calcia-silica with greatest amount of zirconia near the monolithic zirconia layer.

4. A thermal barrier coating system according to claim 1, wherein the ceramic top coat is at least 500 $\mu$m thick.

5. A thermal barrier coating according to claim 1, wherein at least the top coat is deposited by vacuum plasma spray using very fine powders and thus forming a uniformly thick coating with a smooth outer surface.

6. A thermal barrier coating according to claim 5, wherein both the bond coat and the top coat are deposited by vacuum plasma spray.

7. A thermal barrier coating according to claim 1, wherein the bond coat has a dense microstructure while the top coat has a controlled porosity to maximize its thermal barrier properties.

* * * * *